United States Patent [19]

Sickler et al.

[11] 4,271,796

[45] Jun. 9, 1981

[54] PRESSURE RELIEF SYSTEM FOR ENGINE BRAKE

[75] Inventors: Kenneth H. Sickler, Simsbury; Donald J. McCarthy, Wethersfield; Raymond N. Quenneville, Suffield, all of Conn.

[73] Assignee: The Jacobs Manufacturing Company, Bloomfield, Conn.

[21] Appl. No.: 47,499

[22] Filed: Jun. 11, 1979

[51] Int. Cl.[3] ..... F02D 31/00

[52] U.S. Cl. ..... 123/321; 123/322; 137/469

[58] Field of Search ..... 123/97 B, 90.12; 137/469

[56] References Cited

U.S. PATENT DOCUMENTS

| | | | |
|---|---|---|---|
| 1,608,770 | 11/1926 | Caminez | 123/90.12 |
| 1,723,382 | 8/1929 | Shutt | 123/90.12 |
| 2,063,881 | 12/1936 | Noble | 123/90.12 |
| 2,329,662 | 9/1943 | Steiner | 123/90.12 |
| 2,431,769 | 12/1947 | Parker | 137/469 |
| 2,704,549 | 3/1955 | Strnad | 137/469 |
| 2,793,656 | 5/1957 | Frain | 137/469 |
| 2,817,356 | 12/1957 | Glass | 137/469 |
| 2,874,718 | 2/1959 | Kelly | 137/469 |
| 2,968,295 | 1/1961 | Haller | 137/469 |
| 3,194,260 | 7/1965 | Price | 137/469 |
| 3,199,532 | 8/1965 | Trick | 137/469 |
| 3,220,392 | 11/1965 | Cummins | 123/97 B |
| 3,405,699 | 10/1968 | Laas | 123/97 B |
| 3,651,827 | 3/1972 | Hammer | 137/469 |
| 3,859,970 | 1/1975 | Breisin | 123/97 B |
| 4,150,640 | 4/1979 | Egan | 123/97 B |

*Primary Examiner*—Ronald B. Cox
*Attorney, Agent, or Firm*—Donald E. Degling

[57] ABSTRACT

A pressure relief system for an internal combustion engine compression relief engine brake is disclosed. The pressure relief system comprises a bi-stable ball relief valve associated with the high pressure hydraulic system together with damping means adapted to damp out rapidly the oscillations of the ball valve during the period of its opening so as to maximize the flow of hydraulic fluid through the bi-stable valve and minimize the time required to relieve the pressure in the high pressure hydraulic system of the compression relief engine brake. The damping means comprises a spring controlled ball valve guide which inhibits premature reseating of the bi-stable ball valve and maximizes the average opening of the valve during its operating period.

11 Claims, 6 Drawing Figures

PRESSURE RELIEF SYSTEM FOR ENGINE BRAKE

BACKGROUND OF THE INVENTION

1. Field of the Invention

This invention relates generally to the field of compression relief engine brake for internal combustion engines. More particularly, it relates to a pressure relief system which automatically disables, one or more operating cylinders of, the compression relief engine brake whenever the forces in the hydraulic circuit of the engine brake exceed a predetermined level.

2. Prior Art

Engine brakes of the compression relief type are well known in the art. Such engine brakes are designed to convert, temporarily, an internal combustion engine of the spark ignition or compression ignition type into an air compressor so as to develop a retarding horsepower which may be a substantial portion of the operating horsepower normally developed by the engine.

As a general rule, so long as the retarding horsepower developed during braking operations does not exceed in absolute value the operating horsepower for which the engine was designed, the stresses on the crankshaft, bearings and drive train, though opposite in direction will not exceed the allowable stresses for these parts and the addition of the compression relief engine brake will not adversely affect the operating life of the drive train components of the engine and vehicle. At the same time, the engine brake will supplement the braking capacity of the primary vehicle wheel braking system and extend, substantially, the life of the primary braking system. The basic design for an engine braking system of the type here involved is disclosed in the Cummins U.S. Pat. No. 3,220,392.

The compression relief engine brake of the type disclosed in U.S. Pat. No. 3,220,392 employs a hydraulic system wherein the motion of a master piston controls the motion of a slave piston which opens the exhaust valve of the internal combustion engine near the end of the compression stroke whereby the work done in compressing the intake air is not recovered during the expansion or "power" stroke but, instead, is dissipated through the exhaust and radiator systems. The master piston is customarily driven by a pushrod controlled by the engine camshaft. It will be apparent that the force required to open the exhaust valve will be transmitted back through the hydraulic system to the pushrod and camshaft. In order to minimize modification of the engine, it is common to utilize an existing pushrod which moves at the appropriate time to operate the engine brake hydraulic system. In some cases, an exhaust valve pushrod is selected while, in other cases, it is convenient to use the fuel injector pushrod.

However, by assigning a second function to an existing pushrod, the possibility exists that an increased load which may exceed the design capacity of the pushrod or camshaft may be experienced. In order to avoid damage to the engine pushrod or camshaft, it is desirable to provide an automatic means to unload the engine brake whenever an excessive loading condition becomes imminent. But it is also important automatically to reactivate the engine brake as soon as the temporary excess loading condition has terminated so as not to interfere with the effectiveness of the engine brake.

It has been known to provide means to unload the brake hydraulic system when excess motion of the exhaust valve occurs, see Laas U.S. Pat. No. 3,405,699. Similarly, quick opening relief or check valves of various designs have been disclosed in a number of patents including Parker U.S. Pat. No. 2,431,769, Frain U.S. Pat. No. 2,793,656, Glass et al U.S. Pat. No. 2,817,356, Kelly U.S. Pat. No. 2,874,718, Price U.S. Pat. No. 3,194,260, Trick U.S. Pat. No. 3,199,532, Chapman et al U.S. Pat. No. 3,589,386 and Hammer et al U.S. Pat. No. 3,651,827.

SUMMARY OF THE INVENTION

An object of the present invention is to provide a pressure relief system for an engine brake of the compression relief type which will respond rapidly to an excess hydraulic pressure in the brake system and maintain the system pressure for the balance of a cycle at a fraction of the predetermined pressure whenever an excess pressure is sensed. Another object of the invention is to provide a pressure relief system in which the pressure drop will occur rapidly and with a minimum number of pressure oscillations. Another object is to provide a pressure relief system which automatically resets itself after operation so as to restore the system to the regular operating mode. A still further object is to provide a pressure relief system capable of being retrofitted into an existing engine brake without requiring any modification of the existing apparatus. In accordance with the present invention, these and other advantages are accomplished by providing a special design multistage pressure relief valve which may be accommodated within the master piston of the engine brake.

DETAILED DESCRIPTION OF THE INVENTION

Figure 1:
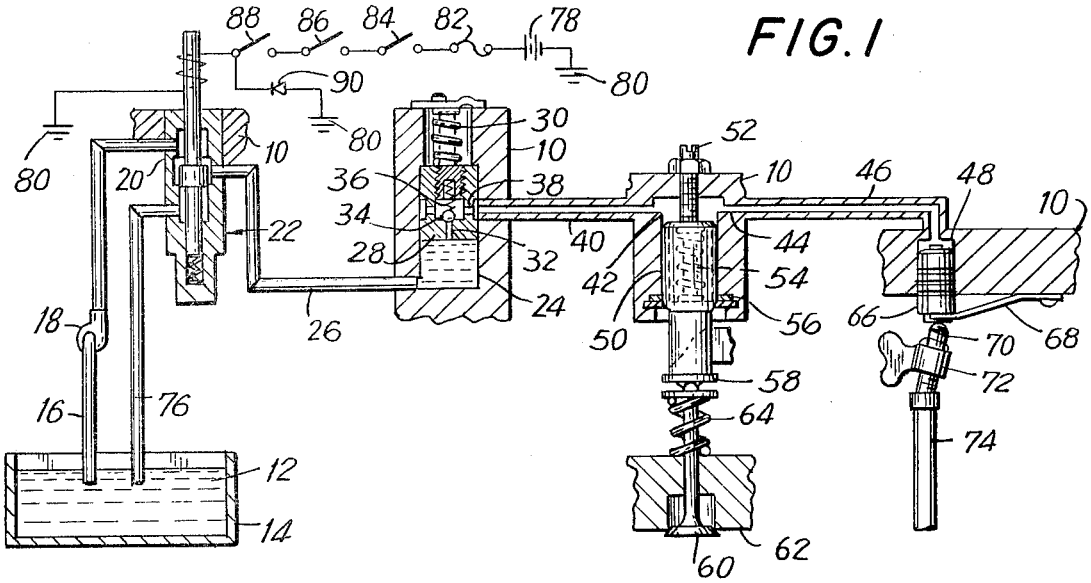
FIG. 1 is a schematic drawing of a compression relief engine brake incorporating the improved pressure relief system in accordance with the present invention.

FIG. 1 is a schematic diagram of a compression relief engine brake adapted for use in conjunction with an internal combustion engine of the spark ignition or compression ignition type. As noted above, the basic design of the compression relief brake is disclosed in the Cummins U.S. Pat. No. 3,220,392. For purposes of simplicity and clarity, the present invention will be described with reference to an engine brake applied to a Cummins compression ignition engine in which the master piston of the engine brake is driven by the injector pushrod. It will be understood that the invention may also be applied to other applications where, for example, the master piston is driven by an exhaust valve pushrod. Moreover, as will be explained below, the pressure relief device herein disclosed may be placed at any convenient point in the high pressure hydraulic circuit although its combination with the master piston is particularly desirable.

Referring now to FIG. 1, the numeral 10 represents a housing fitted on an internal combustion engine within which the components of a compression relief engine brake are contained. Oil 12 from a sump 14 which may be, for example, the engine crankcase is pumped through a duct 16 by a low pressure pump 18 to the inlet 20 of a solenoid valve 22 mounted in the housing 10. Low pressure oil 12 is conducted from the solenoid valve 22 to a control cylinder 24 by a duct 26. A control valve 28 is fitted for reciprocating movement within the control cylinder and is urged into a closed position by a compression spring 30. The control valve 28 contains an inlet passage 32 closed by a ball check valve 34 which is biased into the closed position by a compression spring 36 and an outlet passage 38. When the control valve 28 is in the open position (as shown in FIG. 1) the outlet passage 38 registers with the control cylinder outlet duct 40 which communicates with the inlet of a slave cylinder 42 also formed in the housing 10. It will be understood that low pressure oil 12 passing through the solenoid valve 22 enters the control valve cylinder 24 and raises the control valve 28 to the open position. Thereafter, the bail check valve 34 opens against the bias of spring 36 to permit the oil 12 to flow into the slave cylinder 42. From the outlet 44 of the slave cylinder 42 the oil 12 flows through a duct 46 into the master cylinder 48 formed in the housing 10.

A slave piston 50 is fitted for reciprocating motion within the slave cylinder 42. The slave piston 50 is biased in an upward direction (as shown in FIG. 1) against an adjustable stop 52 by a compression spring 54 which is mounted within the slave piston 50 and acts against a bracket 56 seated in the slave cylinder 42. The lower end of the slave piston 50 acts against an exhaust valve cap or crosshead 58 fitted on the stem of exhaust valve 60 which is, in turn, seated in the engine cylinder head 62. An exhaust valve spring 64 normally biases the exhaust valve 60 to the closed position as shown in FIG. 1. Normally the adjustable stop 52 is set to provide a clearance of about 0.018 inch (i.e. "lash") between the slave piston 50 and the exhaust valve cap 58 when the exhaust valve 60 is closed, the slave piston 50 is seated against the adjustable stop 52 and the engine is cold. This clearance is required and is normally sufficient to accommodate expansion of the parts comprising the exhaust valve train when the engine is hot without opening the exhaust valve 60.

A master piston 66 is fitted for reciprocating movement within the master cylinder 48 and biased in an upward direction (as viewed in FIG. 1) by a light leaf spring 68. The lower end of the master piston 66 contacts an adjusting screw mechanism 70 of a rocker arm 72 controlled by a pushrod 74 driven from the engine camshaft (not shown). As noted above, when applied to the Cummins engine, the rocker arm 72 is conveniently the fuel injector rocker arm and the pushrod 74 is the injector pushrod. In this circumstance, the pushrod 74 and the exhaust valve 60 are associated with the same engine cylinder.

It will be understood that when the solenoid valve 22 is opened, oil 12 will raise the control valve 28 and then fill both the slave cylinder 42 and the master cylinder 48. Reverse flow of oil out of the slave cylinder 42 and master cylinder 48 is prevented by the action of the ball check valve 34. However, once the system is filled with oil, upward movement of the pushrod 74 will drive the master piston 66 upwardly and the hydraulic pressure, in turn, will drive the slave piston 50 downwardly to open exhaust valve 60. The valve timing is selected so that the exhaust valve 60 is opened near the end of the compression stroke of the cylinder with which the exhaust valve 60 is associated. Thus, the work done by the engine piston in compressing air during the compression stroke is released to the exhaust and radiator systems of the engine and not recovered during the expansion stroke of the engine.

When it is desired to deactivate the compression brake, the solenoid valve 22 is closed whereby the oil 12 in the control valve cylinder 24 passes through the duct 26, the solenoid valve 22 and the return duct 76 to the sump 14. When the control valve 28 drops downwardly as viewed in FIG. 1, a portion of the oil in the slave cylinder 42 and master cylinder 48 is vented past the control valve 28 and returned to the sump 14 by duct means (not shown).

The electrical control system for the engine brake includes the vehicle battery 78 which is grounded at 80. The hot terminal of the battery 78 is connected, in series, to a fuse 82, a dash switch 84, a clutch switch 86, a fuel pump switch 88 and, preferably, through a diode 90 back to ground 80. The switches 84, 86 and 88 are provided to assure the safe operation of the system. Switch 84 is a manual control to deactivate the entire system. Switch 86 is an automatic switch connected to the clutch to deactivate the system whenever the clutch is disengaged so as to prevent engine stalling. Switch 88 is a second automatic switch connected to the fuel system to prevent engine fueling when the engine brake is in operation.

Figure 2:
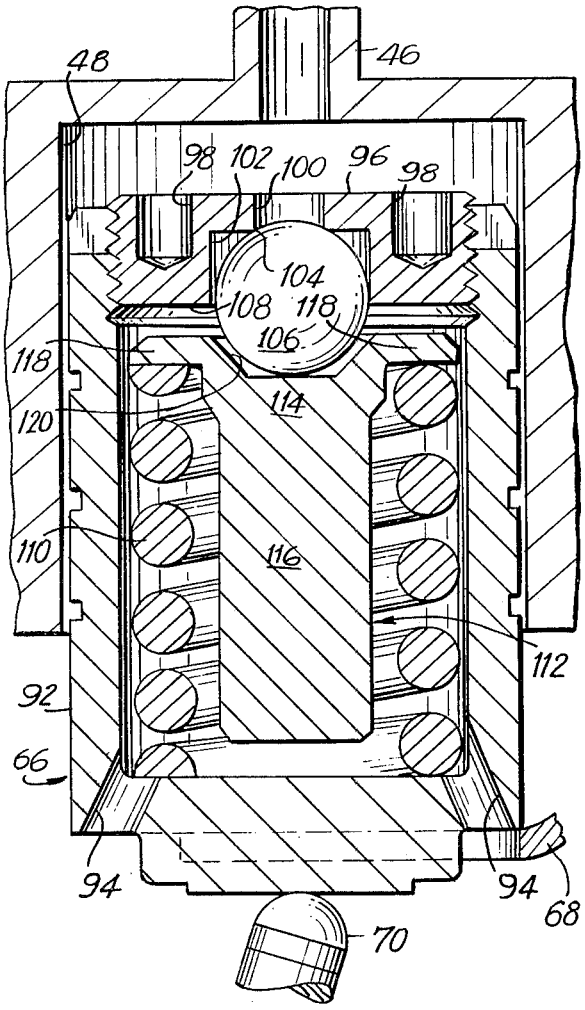
FIG. 2 is an enlarged cross-sectional view of an engine brake master cylinder incorporating a pressure relief system according to the present invention.

Reference is now made to FIG. 2 which shows in an enlarged cross-sectional view one form of a modified master piston in accordance with the present invention. The master piston 66 comprises a hollow cylindrical body 92 open at the top and having a plurality of drainage passageways 94 communicating between the interior and exterior of the body 92. A cap 96 is threaded into the top of the body 92 and contains adjusting bores 98 adapted to receive an appropriate wrench or spanner (not shown). A central or primary orifice 100 is formed in the cap 96 and communicates with a larger valve bore or secondary orifice 102. The intersection of the orifice 100 and the valve bore 102 defines a valve seat 104 for a ball valve 106. The diameter of the ball valve 106 is selected so as to be slightly smaller than the bore 102 while the cap 96 has a thickness such that the bottom surface 108 lies slightly below the center of the ball valve 106. A spring 110 mounted within the body 92 of the master piston 66 carries a ball guide 112 which biases the ball valve 106 against the valve seat 104. The ball guide includes a seat portion 114 and a plunger portion 116 designed to limit the downward motion of the ball guide 112 before the spring 110 becomes fully compressed.

In operation, it will be understood that the pressure in the high pressure side of the engine brake hydraulic system which includes the slave cylinder 42 and the master cylinder 48 will be transmitted through the master piston 66 and will appear as a force tending to compress or buckle the pushrod 74. In addition, the force required to operate the fuel injector will be carried as a moment by the rocker arm 72 and then reflected as a compressive or buckling force on the pushrod. However, the hydraulic pressure alone will act on the ball valve 106 over an area defined by the orifice 100 to produce a force tending to open the ball valve. If the force due to the hydraulic pressure exceeds the force due to the spring 110, the ball 106 will be displaced slightly from the seat 104 whereupon the hydraulic pressure will act on the full projected cross-section of the ball valve 106, an area known as the "secondary" area. As a result, the ball valve 106 will be rapidly accelerated to the fully displaced position as limited by contact between the plunger end 116 of the ball guide 112 with the bottom of the piston body 92.

Applicants have found that in order to cause the pressure to be dumped rapidly with a minimum of pressure oscillation it is important accurately to define the ratio of the annular area between the inside of the piston body 92 and the outer periphery of the shoulder portion 118 and the area of the orifice 100. This area may be called the "tertiary" area as distinguished from the "primary" area of the orifice 100 and the "secondary" projected area of the ball 106. Applicants have discovered that the ratio of these areas should be at least 1.0 and preferably about 1.5. Where the ratio is less than 1.0 a throttling of the flow of hydraulic flow would occur which tends to decrease the rate at which hydraulic fluid is dumped through the piston. When the area between the shoulder 118 of the ball guide 112 and the inner wall of the master piston body 92, the "tertiary" area is controlled so as to be between about 100% and 150% of the size of the orifice 100, the resistance to the flow of hydraulic fluid is sufficient so that the pressure acts on the upper surface of the ball guide 112 and quickly damps out the vibratory motion of the ball guide 112 and the ball valve 106 resulting from the reaction of the spring 110. As a result, the average opening and the average time in the open position of the valve 106 are increased whereby the flow through the valve is maximized. Tests have shown that when the ratio of the tertiary and primary areas exceeds about 150% the damping effect on the normal vibratory motion of the ball valve 106 and the ball guide 112 is diminished and when the area ratio is below 100% secondary throttling occurs which also restricts the flow of hydraulic fluid through the piston 66.

In addition, applicants believe that the result of locating the bottom 108 of the cap 98 below the center of the ball 106 is that the ball 106 when fully contained in the valve bore 102 allows a pressure to develop behind the ball 106 in the valve bore 102 and this causes a greater acceleration and increased velocity of the ball. The effect is that the ball valve is open for a longer time and the average opening is greater whereby the flow through the ball valve is maximized.

It will be understood that while a relatively high hydraulic pressure is required initially to unseat the ball valve 106, a much smaller pressure is required to maintain the ball valve in the open position. The ratio of these pressures is approximately equal to the inverse ratio of the area of the orifice 100 and the cross-sectional area of the ball valve 106. The total area of the drainage passageways 94 should be greater than the area of the orifice 100 and the opening between the ball valve 106 and the bore 102 to insure that the drainage passageways 94 do not throttle the flow of hydraulic fluid. It will therefore be appreciated that the valve 106 opens, it will remain open in a stable condition until a sufficient quantity of hydraulic fluid has been dumped so as to establish a low pressure level in the hydraulic system. The pressure at which the valve 106 will begin to open is controlled by the bias exerted by the spring 110 which acts through the valve guide 112 to hold the valve 106 against the seat 104. Such bias may be regulated by adjusting the cap 96 until the desired load on the spring 110 is attained. Once adjusted, the cap 96 may be staked or otherwise locked in the body 92 of the master piston 66 to maintain the adjustment.

It will be understood, that after the hydraulic pressure in the high pressure system has been relieved, the valve 106 will automatically reseat and the hydraulic system will be restored to its normal operating mode. Thus, the engine brake will again be in a condition to operate.

Figure 3:
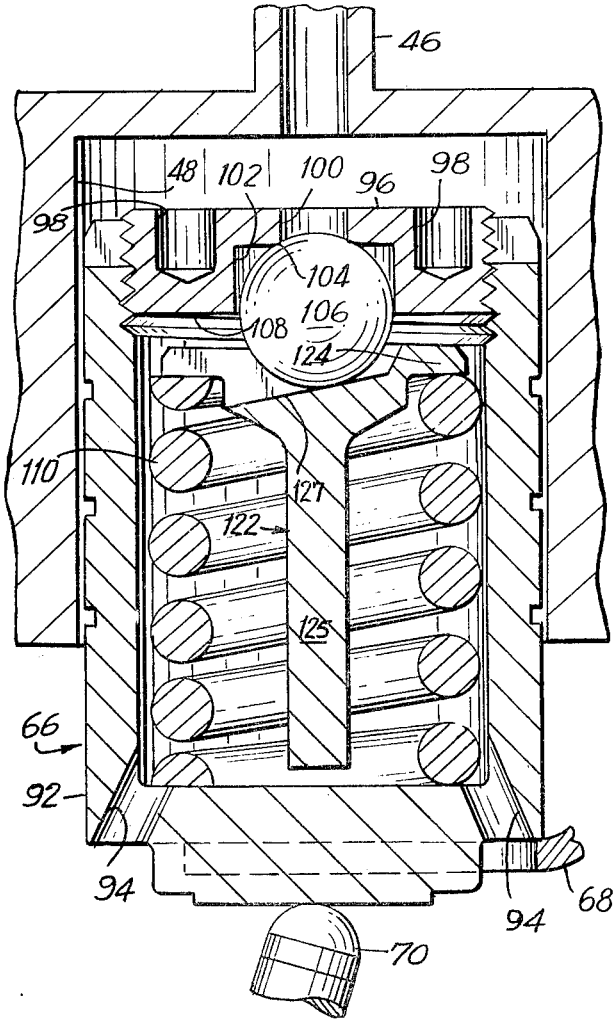
FIG. 3 is an enlarged cross-sectional view of an engine brake master cylinder having a modified pressure relief system according to the present invention.

Referring now to FIG. 3, another form of a pressure relief valve is shown. Parts which are common to both FIGS. 2 and 3 bear the same identification. The principal difference in construction lies in the structure of the valve guide 122 of FIG. 3 which comprises an assymmetric structure having a radially extending shoulder portion 124, an axially extending plunger portion 125 and a skew seat 127. By the term "skew seat", applicants mean that the plane of the seat in the valve guide 122 against which the valve 106 acts is not normal or perpendicular to the axis of the guide 122 but, instead, is inclined with respect to that axis as is clearly shown in FIG. 3. In this case the valve 106 should be a ball valve. If the force due to hydraulic pressure exceeds the force due to the spring 110, the ball 106 will be displaced slightly from the seat 104 whereupon the hydraulic pressure will act upon the full projected cross-section of the ball valve 106. As a result, the ball valve 106 will be rapidly accelerated to the fully displaced position and will tend to "ride down" the skew seat 127. The resulting skew movement of the ball valve 106 in combination with the impact of the plunger 125 against the bottom of the piston body 92 tends quickly to damp out vibrations and inhibit the ball valve 106 from reseating itself before the hydraulic pressure has been fully dissipated by the flow of hydraulic fluid through the piston body 92 and then through the drainage passageways 94. As in the case of the structure shown in FIG. 2, the bottom edge 108 of the cap 96 extends slightly below the center of the ball 106 whereby a pressure of hydraulic fluid tends to be built up in the valve bore 102 which accelerates the ball 106 to a high velocity whereby the ball valve is opened more rapidly to maximize the flow of hydraulic fluid therethrough.

Figure 4:
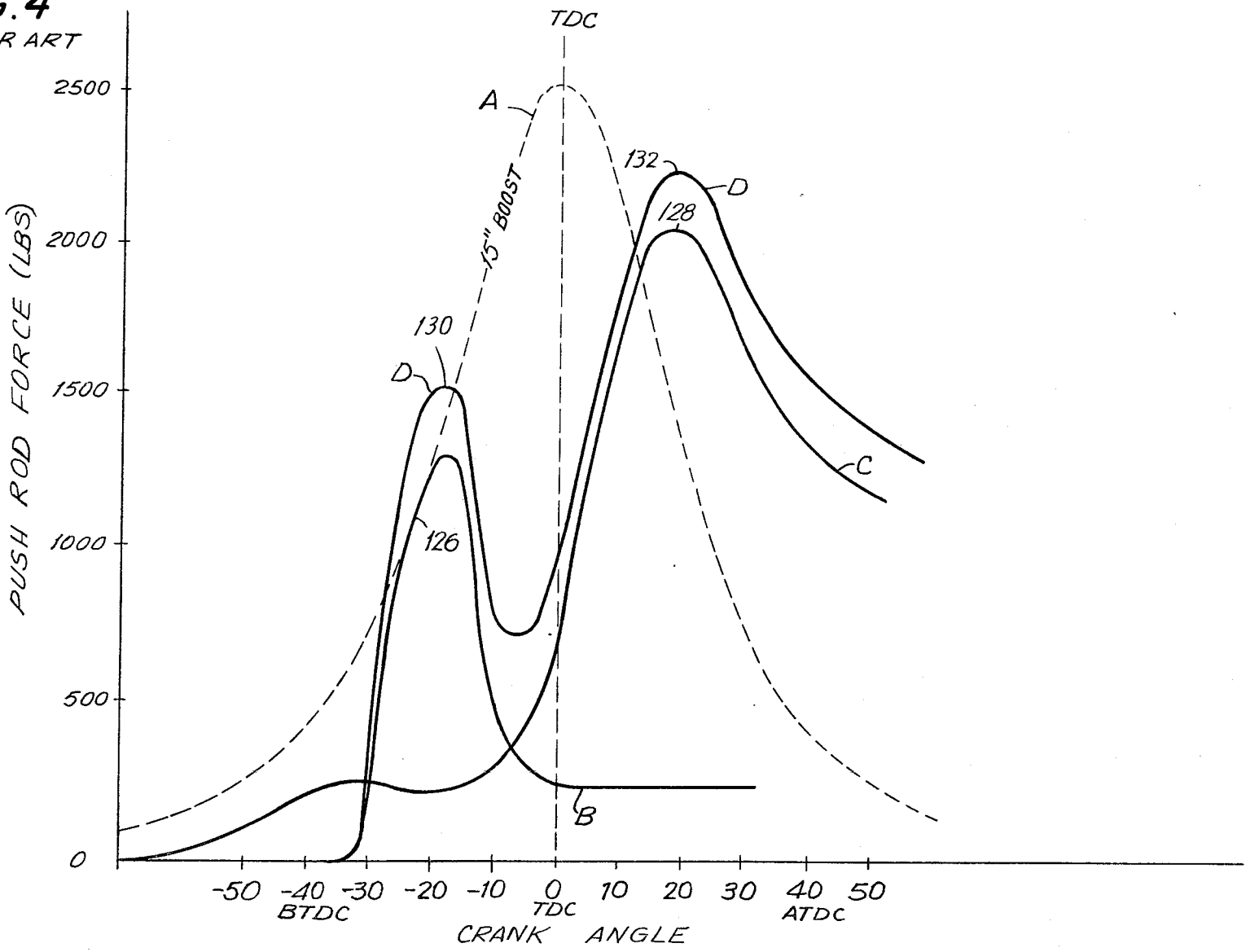
FIG. 4 PRIOR ART
FIG. 4 is a diagram showing the variation in the force exerted on the pushrod to open the exhaust valve and to actuate the fuel injector as a function of engine crank angle position.

Reference is now made to FIG. 4 in which pushrod force is plotted against engine crank position in terms of the crank angle before and after top dead center (TDC). Curve A represents the force required at the injector pushrod to open an exhaust valve. This is the force transmitted through the high pressure hydraulic system of the engine brake by the slave piston 50 and the master piston 66. Curve A is in the form of a bell curve essentially symmetric about the TDC point and reflects the changing pressure within the cylinder. Curve A may be displaced vertically depending upon the degree of boost given by the engine supercharger. In FIG. 4, Curve A is shown with a typical normal boost of 15 inches of mercury. If a higher boost were used, the curve would be raised while with a lower boost it would be lowered.

Curve B represents the force induced in the pushrod to open the exhaust valve and hold it open. Until the clearance or lash in the system is taken up, essentially no force is induced in the pushrod. However, once the clearances are taken up, the force in the pushrod builds rapidly until the exhaust valve begins to open. Once the exhaust valve begins to open as a result of the coincidence of Curves B and A at point 126 (FIG. 4), Curve B will peak and then drop to a low level determined essentially by the force exerted by the exhaust valve spring 64.

Curve C represents the force induced in the pushrod due to the operation of the fuel injector train. This force normally peaks shortly after TDC and the peak, indicated at point 128, represents the crushing load on the injector train as the injector is mechanically seated in the injector body. The maximum force occurs at point 128 and is considered in the normal design of the engine.

Curve D represents the total force on the pushrod due to the combined effect of the exhaust valve opening load and the injector load and is determined as the sum of the forces shown by Curves B and C. In general, it will be noted that Curve D will have two peaks—the first occurring approximately when the exhaust valve begins to open and the second when the injector seats. These peaks are indicated, respectively, at points 130 and 132. It will be appreciated that if the time interval between the peak loads indicated by points 130 and 132 is decreased for any reason, such as excessive lash in the system or increased supercharger boost, for example, the force required to open the exhaust valve may not have decreased to its minimum value before the maximum injector load occurs with the result that the total load on the injector pushrod becomes excessive and buckling of the pushrod may occur.

Figure 5:
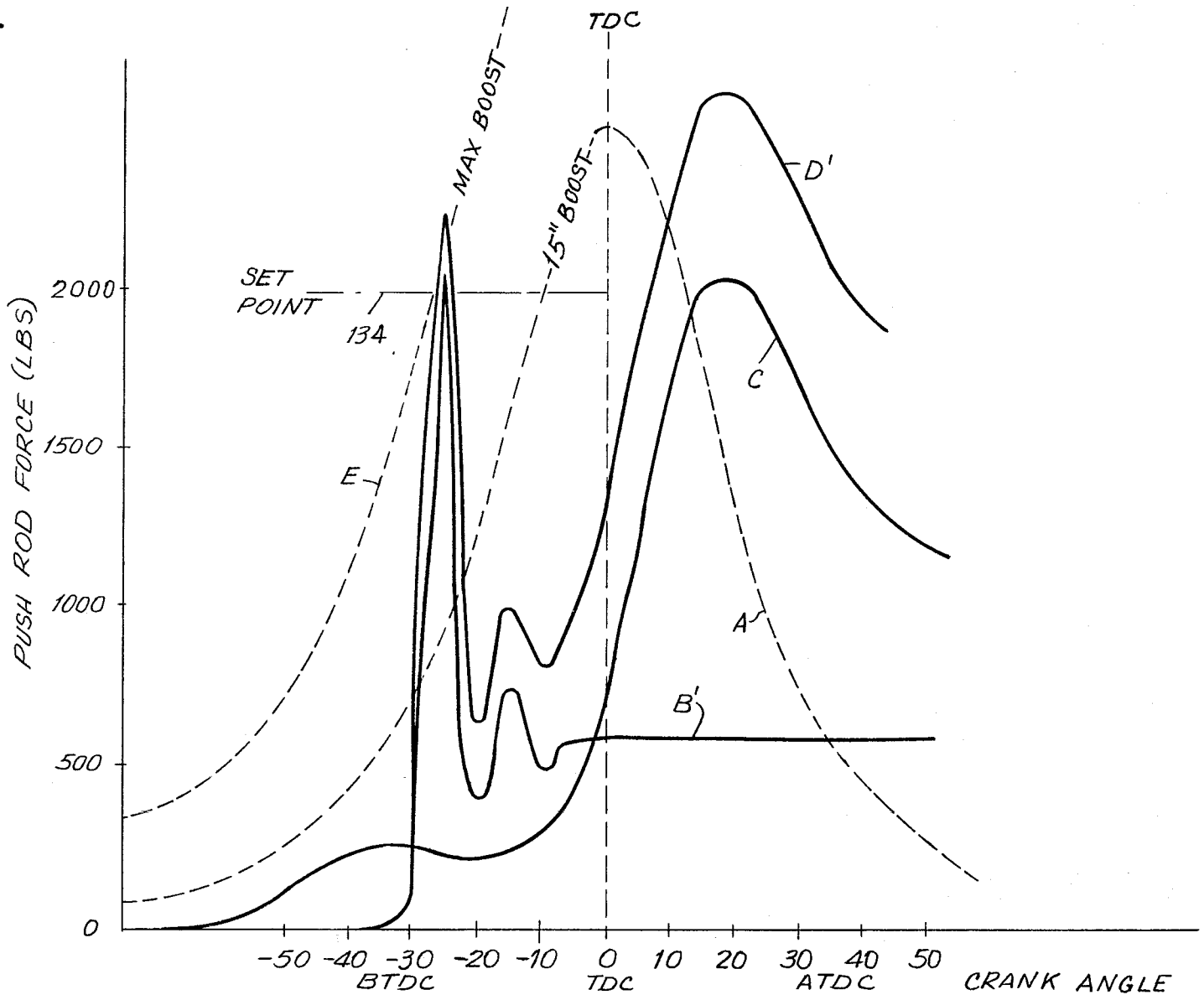
FIG. 5 is a diagram showing the variation in the force exerted on the pushrod as a function of the crank angle when the pressure relief system of the present invention is activated.

FIG. 5 illustrates a typical operation of the present invention wherein the engine brake hydraulic system is unloaded to prevent damage to the injector pushrods when an overload condition occurs as a result of excessive supercharger boost. Curve A is identical to Curve A of FIG. 4 and represents a normal 15 inch supercharger boost while Curve E indicates the maximum boost capable of being provided by the engine supercharger. Curve C is also identical to Curve C of FIG. 4 and represents the force on the injector pushrod due to the injector load alone.

The line 134 represents the set point for the pressure relief system of the present invention. This is the predetermined pressure within the hydraulic system of the engine brake at which the valve 106 will be displaced from its seat 104 so as to dump hydraulic fluid through the master piston 66 and therefore unload the system. Curve B' in FIG. 5 represents the force in the pushrod due to the hydraulic pressure in the engine engine brake mechanism and the exhaust valve train. It is similar to Curve B of FIG. 4 but, because of the increased supercharger boost, the curve reaches the set point 134 before it coincides with the boost curve E. As a result, the exhaust valve will not be opened. Instead, the pressure in the hydraulic system will be dumped to a lower stable level determined by the characteristics of the specific pressure relief system employed as described above in connection with FIGS. 2 and 3. The total force on the pushrod is therefore shown by the curve D' which, while necessarily in excess of the Curve C, is still within the designed capacity of the pushrods. It will be understood that the set point 134 is selected in combination with the relative dimensions of the ball valve 106 and its bi-stable settings such that the resultant force on the pushrods does not exceed a safe load.

From a consideration of FIG. 5, it is apparent that not only must the stable force on the pushrods be limited, but the fugitive oscillations in this force should be dissipated before the injector load becomes operative. Applicants have discovered that rapid damping of these force oscillations can be accomplished by the special designs of the pressure relief systems disclosed herein. In FIG. 3, the skewed seat 127 prevents the ball valve 106 from reseating prematurely as a result of such fugitive oscillations. Similarly, a control of the ratio of the area of the clearance space between the shoulders 118 and the piston body 92 and the area of the orifice 100 as shown in FIG. 2 is also effective to prevent premature reseating of the valve 106.

Figure 6:
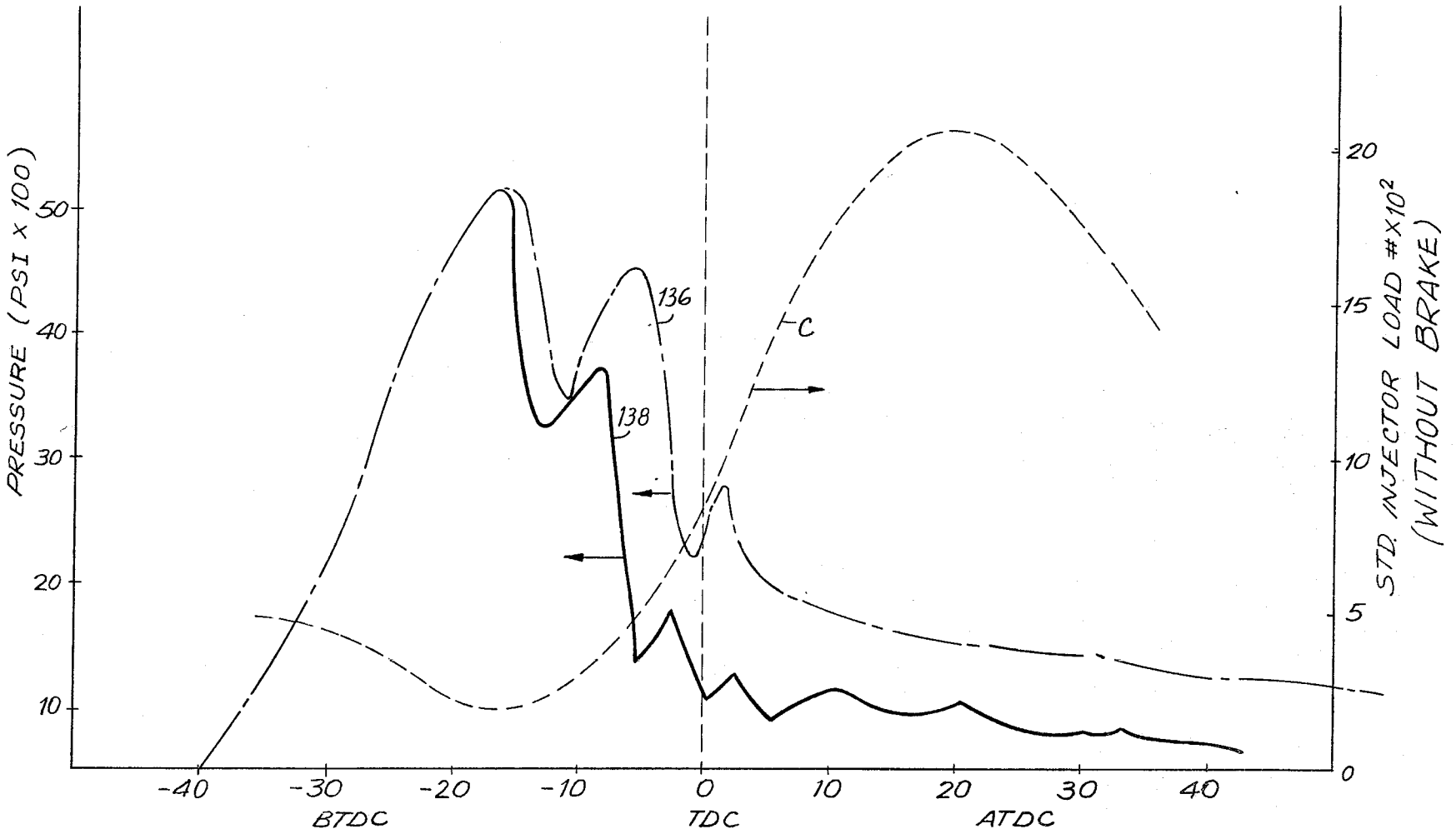
FIG. 6 is a graph of engine brake hydraulic pressure as a function of the engine crank angle for two configurations of the pressure relief device shown in FIG. 2.

FIG. 6 is a graph showing the effect of the variations in the size of the fluid flow passages of the configuration of FIG. 2 on the performance of the pressure relief system. For the tests represented by FIG. 6, a pressure relief system of the type shown in FIG. 2 was employed wherein the area of the orifice 100 (the "primary" area) was 0.0102 square inches. Curve 136 shows the performance of a pressure relief system wherein the area between the inner surface of the master piston body 92 and the shoulder 118 of the ball guide 112 (the "tertiary" area) was 0.0676 square inches while Curve 138 shows the improved performance resulting from a decrease in the size of the orifice between the shoulder 118 and the inner surface of the master piston body 92 (the "tertiary" area) to 0.0146 square inches. Curve C of FIG. 6 is identical to Curve C of FIGS. 4 and 5 and is reproduced for reference in the following discussion. FIG. 6 shows two improvements which result from the change exemplified by Curve 138: First, the pressure maintained in the system after TDC was substantially lower and, second, the time, measured in crank angle degrees required to dump the pressure, was substantially decreased. Both effects are important: The first reduces the total maximum load on the injector pushrod while the second tends to separate the effect of the peak load required to open the exhaust valve from the injector seating load.

Applicants believe that when the area between the shoulder 118 of the ball guide 112 and the inner wall of the master piston body 92, the "tertiary" area is controlled so as to be between about 100% and 150% of the size of the orifice 100, the resistance to the flow of hydraulic fluid is sufficient so that the pressure acts on the upper surface of the ball guide 112 and quickly damps out the vibratory motion of the ball guide 112 and the ball valve 106 resulting from the reaction of the spring 110. As a result, the average opening and the average time in the open position of the valve 106 are increased whereby the flow through the valve 106 is maximized. Tests have shown that when the ratio of the tertiary and primary areas exceeds about 150% the damping effect on the normal vibratory motion of the ball valve 106 and the ball guide 112 is diminished and when the area ratio is below 100% secondary throttling occurs which also restricts the flow of hydraulic fluid through the piston 66.

Applicants believe that a similar damping phenomena occurs in the pressure relief system shown in FIG. 3 although in that case it is believed that the damping is a result of mechanical contact between the seat 127, the ball 106 and the lower edge 108 of the cap 96.

By incorporating the pressure relief system into the master piston as shown in FIGS. 2 and 3, applicants provide a convenient mechanism whereby existing compression relief engine brakes may be retrofitted to gain the advantages of the present system at minimum cost. It will also be noted that the hydraulic fluid which is vented from the system is returned to the system without the need for additional ducts or pumps since it is delivered to the pushrod area, an area where hydraulic fluid is normally present.

However, the pressure relief system herein contemplated may be placed at any point in the high pressure hydraulic fluid circuit, for example, in ducts 40 or 46. While in such locations, the dimensional limitations presented by the master piston 66 are not present, hydraulic fluid return ducts would be required. It will be understood that if the pressure relief system of the present invention were placed elsewhere in the high pressure circuit, the body 92 or its equivalent would be threaded or otherwise connected to the high pressure circuit and the drainage passageways would be connected to a hydraulic fluid return duct. In such a system, it is apparent that either the three area pressure relief valve as shown in FIG. 2 or the equivalent two area and skew seat pressure relief valve of FIG. 3 could be employed. However, because of the elimination of the dimensional constraints, determined by the shape and size of the master piston in such a modification, the coil spring 110 and the ball guide 122 of FIG. 3 may be combined in the form an equivalent leaf spring having a ball engaging surface of the shape and orientation of the ball guide seat 127 and a spring rate equal to that of the coil spring 110. Such a modification would operate in a manner similar to the pressure relief system of FIG. 3, as described hereinbefore but, as also noted, could be located at any convenient point in the high pressure hydraulic system.

The terms and expressions which have been employed are used as terms of description and not of limitation and there is no intention in the use of such terms and expressions of excluding any equivalents of the features shown and described or portions thereof, but it is recognized that various modifications are possible within the scope of the invention claimed.

What is claimed is:

1. In an engine braking system of a gas compression relief type including an internal combustion engine having exhaust valve means and pushrod means, hydraulically actuated first piston means associated with said exhaust valve means to open said exhaust valve means at a predetermined time, second piston means actuated by said pushrod means and hydraulically interconnected with said first piston means, the improvement comprising a pressure relief system operable between a first high pressure condition and a second low pressure condition, said pressure relief system comprising a bistable ball valve located in the hydraulic system comprising said interconnected first and second piston means, said bi-stable ball valve having primary and secondary orifices and damping means associated with said ball valve to rapidly damp out vibrations of said ball valve as it moves from its closed position defining said high pressure condition to its open position defining said low pressure condition whereby the flow through said ball valve is maximized and the time required to attain the low pressure condition is minimized.

2. An apparatus as described in claim 1 wherein said damping means comprises a ball valve guide located within said second piston means, a spring located within said second piston means to bias said ball valve guide against said ball valve and urge said ball valve to a normally closed position and a hydraulic fluid drainage passageway in said second piston means, said ball valve guide having a ball guide seat portion the diameter of which is smaller than the inside diameter of said secondary piston means thereby defining a tertiary area at least equal to the area of the primary orifice of said bi-stable ball valve.

3. An apparatus as described in claim 2 wherein said tertiary area is at least equal to area of the primary orifice of said bi-stable ball valve but less than about 150% of the area of said primary orifice.

4. An apparatus as described in claim 3 wherein the area of said hydraulic fluid drainage passageway is at least equal to the area of said primary ball valve orifice.

5. An apparatus as described in claim 4 wherein the position of the bi-stable ball valve may be varied relative to the bottom surface of said second piston means whereby the bias between said ball valve and said ball valve guide induced by said spring may be varied.

6. An apparatus as described in claim 5 wherein said spring is a coil spring and the maximum travel of said ball valve guide is less than the maximum compression of said coil spring.

7. An apparatus as described in claim 1 wherein said damping means comprises a ball valve guide located within said second piston means, a spring located within said second piston means to bias said ball valve guide against said ball valve and urge said ball valve to a normally closed position and a hydraulic fluid drainage in said second piston means, said ball valve guide having a ball valve seat skewed with respect to the axis of said ball valve guide whereby said ball valve may be displaced from the axis of said ball valve guide when said ball valve is opened.

8. An apparatus as described in claim 7 wherein the area of said hydraulic fluid drainage passageway is at least equal to the area of said primary ball valve orifice.

9. An apparatus as described in claim 8 wherein the position of the bi-stable ball valve may be varied relative to the bottom surface of said second piston means whereby the bias between said ball valve and said ball valve guide induced by said spring may be varied.

10. An apparatus as described in claim 9 wherein said spring is a coil spring and the maximum travel of said ball valve guide is less than the maximum compression of said coil spring.

11. An apparatus as described in claim 1 wherein said damping means comprises a leaf spring member, said leaf spring member having a flat ball-engaging portion extending at a skew angle with respect to the axis of said bi-stable ball valve whereby the point of contact between said leaf spring member and said ball valve is displaced from the axis of said bi-stable ball valve.

* * * * *